US007866842B2

(12) United States Patent
Piperidis

(10) Patent No.: US 7,866,842 B2
(45) Date of Patent: Jan. 11, 2011

(54) FLUORESCENT LAMP REFLECTORS

(75) Inventor: Stavros Piperidis, Thessaloniki (GR)

(73) Assignee: Pilux & Danpex, S.A. (GR)

( * ) Notice: Subject to any disclaimer, the term of this patent is extended or adjusted under 35 U.S.C. 154(b) by 101 days.

(21) Appl. No.: 10/537,183

(22) PCT Filed: Oct. 5, 2004

(86) PCT No.: PCT/GR2004/000048

§ 371 (c)(1),
(2), (4) Date: Jun. 2, 2005

(87) PCT Pub. No.: WO2005/038344

PCT Pub. Date: Apr. 28, 2005

(65) Prior Publication Data

US 2006/0056186 A1 Mar. 16, 2006

(30) Foreign Application Priority Data

Oct. 20, 2003 (GR) ..... 030100429

(51) Int. Cl.
*F21V 7/10* (2006.01)

(52) U.S. Cl. ..... 362/217.1; 362/306; 362/341

(58) Field of Classification Search ..... 362/217, 362/306, 341
See application file for complete search history.

(56) References Cited

U.S. PATENT DOCUMENTS 3,580,126 A * 5/1971 Forkner ..... 84/464 R
4,122,511 A 10/1978 Petersen
4,652,983 A 3/1987 Mytels
7,018,074 B2 * 3/2006 Raby et al. ..... 362/306

FOREIGN PATENT DOCUMENTS

DE 3519498 A1 12/1986
GB 2311124 A 9/1997

* cited by examiner

*Primary Examiner*—Sandra L O Shea
*Assistant Examiner*—Jessica L McMillan
(74) *Attorney, Agent, or Firm*—Bruzga & Associates; Charles E Bruzga

(57) ABSTRACT

Reflector (1) for light concentration and direction in fluorescent lamps with parabolic shape made of thin synthetic film with reflective surface and vertically positioned louvres (4) made of thin flexible and synthetic film through which the reflector (1) is fitted on the fluorescent lamps (3). In the centre of the louvres (4) there is an especially shaped opening (6) which adjusts to the diameter of the lamp (3), so that the lamp (3) can pass through the openings (6) of the louvres (4), retain the reflector (1) on the fluorescent lamp (3) and rotate some degrees in relation to the lamp (3) in order to concentrate the light towards the desired direction.

3 Claims, 3 Drawing Sheets

FLUORESCENT LAMP REFLECTORS

The invention involves a reflector for light concentration and direction which is fitted on fluorescent lamps in order to increase the light efficiency of fluorescent luminaires in new and old installations as well as improve their aesthetic appearance.

One category of fluorescent luminaires is "batten fittings" luminaires which consist of a longitudinal base with a cap that encloses all electrical fittings. One or two fluorescent lamps are fitted outside of the base and are retained by single or twin lamp holders on the tops of the batten fitting so that there will be a certain distance between the lamp and the cap of the base along its length.

In this category of luminaires a large amount of the light emitted by the fluorescent lamps is directed towards the lateral walls and the ceiling where the light diffuses without reaching the work plane or after successive reflections the light reaches the work plane with very low efficiency.

Reflectors made of white painted iron plate can be used along with batten fittings during the initial installation for concentrating and directing the light towards the desired work plane. The reflectors are fitted between the base of the luminaires and the ceiling or on the cap. They must have a certain geometric section which varies depending on the geometry of the luminaires where they will be fitted. The reflectors made of white iron plate due to light diffusion and their shape do not increase light efficiency as much as specular reflectors with parabolic shape.

Specular parabolic reflectors that can be fitted on batten fittings are aluminium specular reflectors, which must be fitted only during the initial installation because their supporting points and their shape should be suitable for the geometry of the luminaire.

These reflectors cannot be easily fitted on existing old lighting installations of batten fittings luminaires since the installation of the luminaires by an experienced technician prerequisites a time-consuming technical preparation. Since batten fittings luminaires are a low cost solution for professional areas, another disadvantage of the specular reflectors made of aluminium is their high cost. Thus, the improvement of the light efficiency of an already existing installation of luminaires is prohibitive procedure.

The invention described here involves the use of a reflector for the concentration and direction of light from fluorescent lamps, which can be easily fitted on any installed batten fitting luminaire irrespective of the geometry and the characteristics of the luminaire and without any kind of preparation processing. This is achieved by easily fitting the reflector on the fluorescent lamps, which are the same from one luminaire to another. The main body of this reflector is made of thin synthetic film with one reflective surface, thermo-mechanically formed to parabolic shape for optimum light concentration and direction. Along the body of the reflector traverse louvres are positioned, made of thin flexible synthetic film and properly shaped at their ends to be securely fixed to the narrow slots of the reflector.

In the centre of the louvres there is a properly shaped opening for adjustment to the diameter of the fluorescent lamp so that the lamp can pass through the opening of the louvre and the reflector can be retained on the fluorescent lamp by means of the louvres. The opening of the louvres is shaped to acute noses which because of the flexibility of the thin synthetic film are adapted to the diameter of the lamp by being slightly tightened. Thus, the reflector can rotate some degrees in relation to the lamp and particularly in relation to the longitudinal axis of the lamp and can be retained at all these different positions by means of tightening.

The distance between the retaining points of the louvre is such that when the louvres are fitted on the reflector they retain the ideal parabolic shape of the reflector and at the same time their parabolic contour is tangent to the inner surface of the reflector.

The thin synthetic film mentioned here as the manufacturing material of the reflector and the louvres is a thin single or multi-layered plastic film or press paper 0.1 mm to 1 mm thick.

The advantages offered by this invention are that the reflector can be fitted on batten fittings luminaires in any existing old or new installation by simply fitting the reflector on the fluorescent lamps of the luminaires without any other intervention or processing of the luminaire. Also, this reflector is made of a thin synthetic material, highly resistant for its intended use and inexpensive, which enables, in combination with its easy installation, its use in existing or new lighting installation increasing light efficiency and enhancing aesthetically the entire installation.

An increase in light efficiency is directly proportional to an decrease in the required electrical energy resulting in energy saving for economical and environmental reasons. The retrofitting of old installations in particular saves money since it is not necessary to change all the already fitted luminaires since the reflector covers the old luminaires that have turned yellow or accumulated dust through the passage of time, etc.

One application method of the invention is mentioned below with references to the attached designs where:

Figure 1:
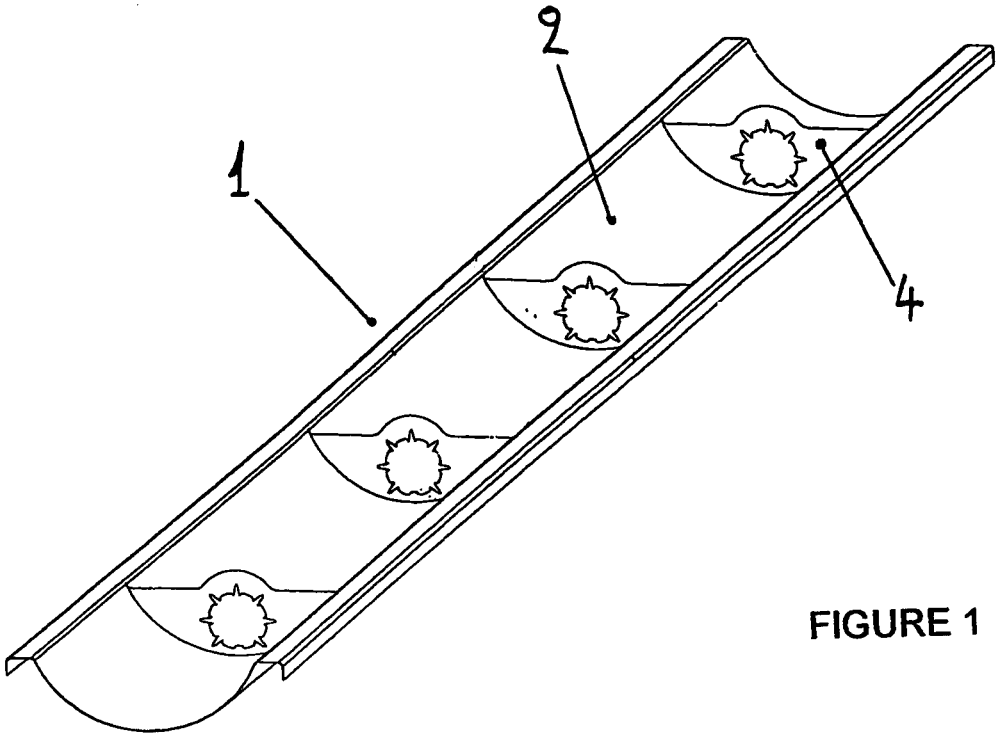
FIG. 1 shows the reflector for light concentration and direction according to the present invention.
Figure 2:
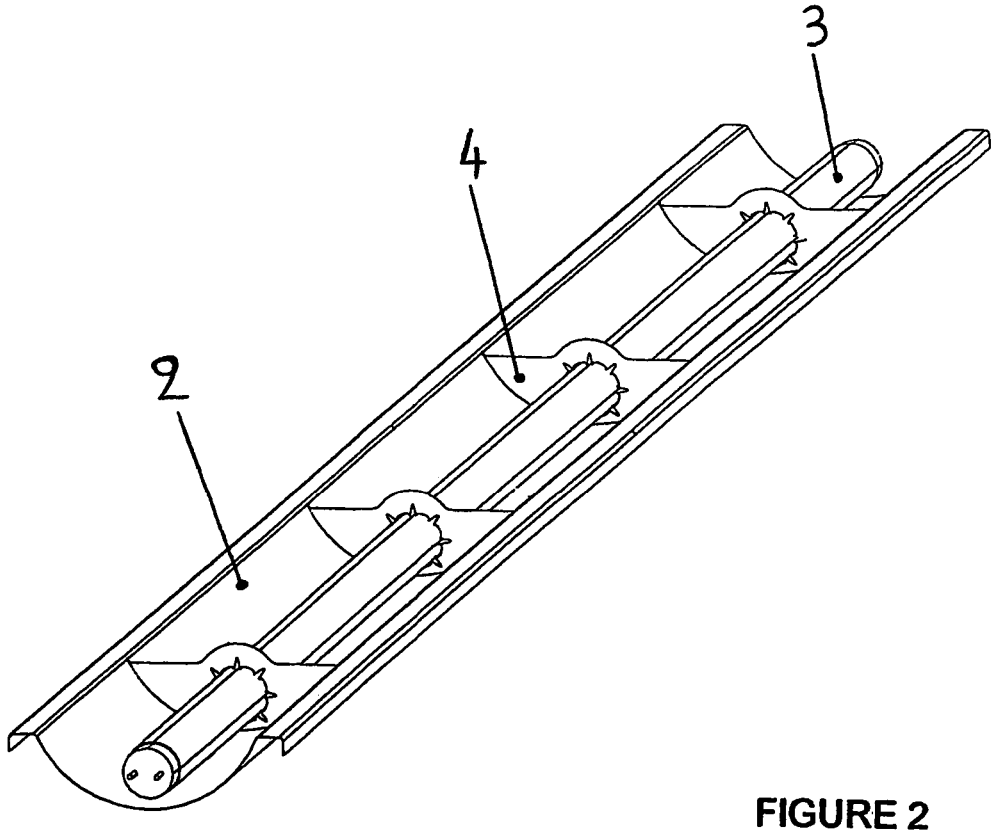
FIG. 2 shows the reflector with the fluorescent lamp fitted through its louvres ready to be fixed to any batten fitting luminaire.
Figure 3:
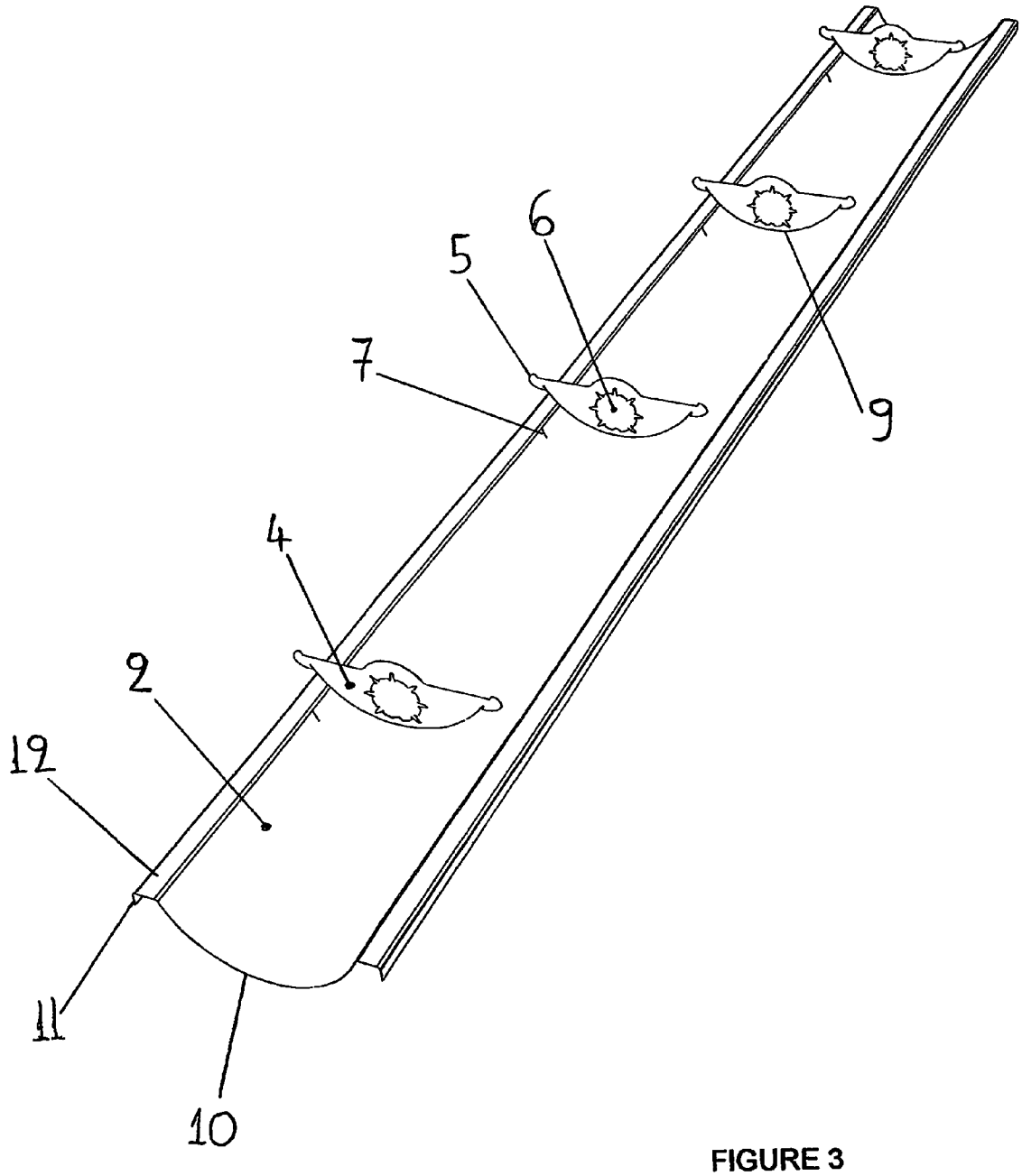
FIG. 3 shows the reflector with the louvres ready to be fitted on the reflector.
Figure 4:
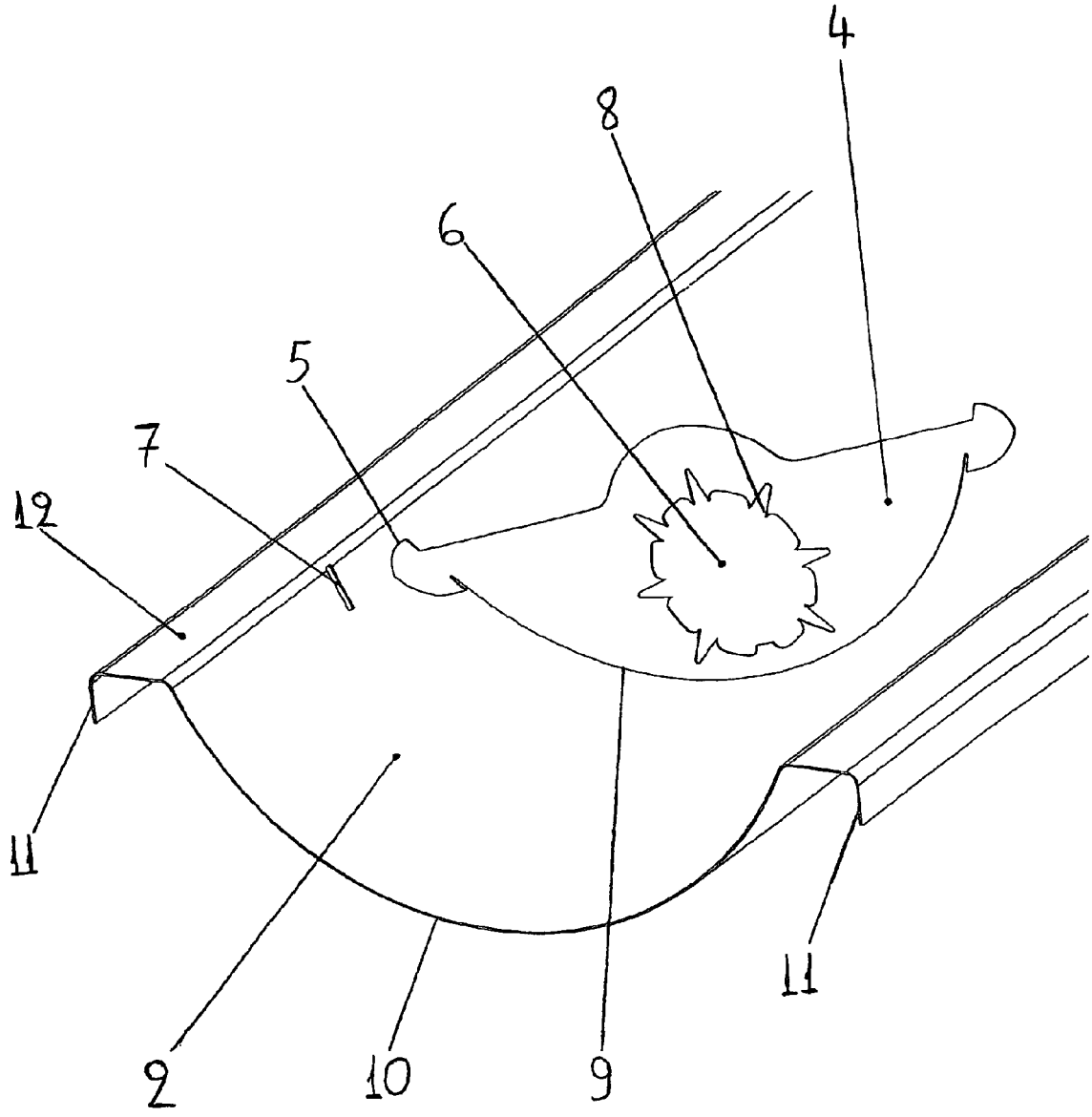
FIG. 4 shows in detail the shape of the louvre and the reflector at their relevant position before fitting the louvre on the body of the reflector.

The reflector (1) of the invention consists of its main body (2) which is made of thin synthetic film with at least one reflective surface in parabolic shape (10) and of vertically positioned louvres (4) which are made of thin synthetic film and they are fitted on the body (2) of the reflector with the aid of their anchor-type ends (5) which are inserted into the corresponding slots (7) of the reflector (2).

The louvres (4) maintain the parabolic section (10) of the reflector (2) along its length thanks to the proper distance of the anchor-type ends (5) and the respective slots (7) of the reflector (2). The parabolic contour (9) of the louvres (4) is tangent to the inner parabolic surface (10) of the reflector (2).

The ribs (11) of the parabolic reflector (2) along its length Increase the flexural strength of the two ends (12) of the reflector (2) and reduce the required number of louvres (4) in order to maintain the parabolic shape (10) of the reflector (2) and the straight line of the two ends (12) along its length.

In the centre of the louvres (4) there is an opening (6) with acute noses (8) inside which are positioned at the imaginary circumference of a circle with a slightly smaller diameter than the standard nominal diameter of the fluorescent luminaire (3) where the reflector (1) will be fitted. The lamp (3) will pass through these openings (6) bending slightly the acute noses (8) in order to adjust to the different diameter of the lamps (3). The thin synthetic film is such flexible that the louvres (4) are not damaged because of the pressure exercised during the passing of the fluorescent lamp (3) into their openings (6).

Thus, the entire reflector (1) is fitted through the louvres (4) on the lamp (3) by tightening the openings (6) on the lamp's body.

The reflector (1) can rotate some degrees left and right around the lamp (3) in relation to the longitudinal axis of the lamp (3) and is retained at these intermediate positions by tightening the acute noses (8) of the openings (6) on the body of the lamp (3). The various positions of the reflector (1) in relation to the lamp (3) contribute to the concentration of the light towards the desired direction. Since the reflector (1) is fitted on fluorescent lamps (3) it is very easy to add reflectors (1) on any fluorescent luminaire in order to increase the light efficiency of the installation and aesthetically enhance old and new installations.

The invention claimed is:

1. Reflector (1) for light concentration and direction, made of a thin synthetic film with a reflective surface in parabolic shape, for mounting on a fluorescent lamp (3) through the louvres (4) traverse fixed to the reflector (2), characterized by the fact that the louvres (4) are made of a thin synthetic and flexible film and the openings of the louvres (4) through which the lamp (3) passes have a plurality of acute noses (8) pointing towards an inner part of the circle and being positioned along each half of the imaginary circumference of a circle with slightly smaller diameter than the standard nominal diameter of the lamp (3), said acute noses (8) can bend a little in order to be adjusted to the slightly bigger diameter of the lamp (3) and retain the reflector (2) by means of friction in different positions when the reflector (2) rotates in relation to the longitudinal axis of the lamp (3).

2. Reflector (1) for light concentration and direction to be fitted on fluorescent lamps (3) as in claim 1, characterized by the fact that, due to the distance between the anchor-shaped ends (5) of the louvre (4), the louvres (4) can maintain the parabolic shape (10) of the reflector (2) along its length when fitted on it.

3. Reflector (1) for light concentration and direction to be fitted on fluorescent lamps (3) as in claim 1, characterized by the fact that the louvres (4) have anchor-shaped ends (5) in the appropriate size so that when the louvres (4) are fitted through the respective slots (7) of the reflector (2), thanks to the flexibility of the thin synthetic film, the anchor-shaped ends (5) click on the body of the reflector (2) and cannot be released due to accidental movement and the stresses exercised on the louvres (4).

* * * * *